US005620276A

United States Patent [19]

Niemerski et al.

[11] Patent Number: 5,620,276

[45] Date of Patent: Apr. 15, 1997

[54] DEFORMABLE IMPACT TEST BARRIER

[75] Inventors: Michael C. Niemerski, Jenison; Gerald J. Schoeb; Fritz Huebner, both of Holland, all of Mich.

[73] Assignee: Plascore, Inc., Zeeland, Mich.

[21] Appl. No.: 536,058

[22] Filed: Sep. 29, 1995

[51] Int. Cl.[6] ..... E01F 13/00

[52] U.S. Cl. ..... 404/6; 404/9; 404/10; 256/1; 256/13.1; 428/116

[58] Field of Search ..... 52/783.11, 783.14, 52/783.17, 784.14, 786.13, 793.1; 404/6, 9, 10; 428/116; 256/1, 13.1

[56] References Cited

U.S. PATENT DOCUMENTS

| | | | |
|---|---|---|---|
| 2,501,180 | 3/1950 | Kunz | 428/116 |
| 2,870,857 | 1/1959 | Goldstein | 181/289 |
| 3,130,819 | 4/1964 | Marshall | 188/377 |
| 3,552,525 | 1/1971 | Schudel | 188/377 |
| 3,757,562 | 9/1973 | Goldberg | 73/12 |
| 3,910,374 | 10/1975 | Holehouse | 181/292 |
| 3,948,346 | 4/1976 | Schindler | 181/286 |
| 4,029,350 | 6/1977 | Goupy | 293/110 |
| 4,154,469 | 5/1979 | Goupy | 293/120 |
| 4,271,219 | 6/1981 | Brown | 428/116 |
| 4,336,292 | 6/1982 | Blair | 428/116 |
| 4,352,484 | 10/1982 | Gertz | 256/13.1 |
| 4,421,811 | 12/1983 | Rose | 428/116 |
| 4,465,725 | 8/1984 | Riel | 428/116 |
| 4,475,624 | 10/1984 | Bourland, Jr. | 181/292 |
| 4,524,603 | 6/1985 | Hargunani | 73/12.01 |
| 5,041,323 | 8/1991 | Rose | 428/116 |
| 5,052,732 | 10/1991 | Oplet | 293/102 |
| 5,106,668 | 4/1992 | Turner | 428/116 |
| 5,180,619 | 1/1993 | Landi | 428/116 |

FOREIGN PATENT DOCUMENTS

| | | | |
|---|---|---|---|
| 678223 | 8/1979 | U.S.S.R. | 188/1 |

*Primary Examiner*—John M. Sollecito
*Assistant Examiner*—Pamela A. O'Connor
*Attorney, Agent, or Firm*—Price, Heneveld, Cooper, DeWitt and Litton

[57] ABSTRACT

An impactor for a movable, deformable barrier, simulating an automobile, comprising an upright, solid backing support, a plurality of energy absorbing impact segments protruding from the support, each segment having an outer impact face and each comprising a plurality of layers of honeycomb having different crush strength characterized by increasing crush strength of successive layers from the outer impact face to the support, the layers being separated by and secured to perforate plates therebetween allowing air flow from a crushing layer to the succeeding layers when the layers are successively crushed and each impact segment having a thin vent layer of noncrushing slotted honeycomb adjacent the support for discharge of air from all of the segments as they are successively crushed. The layers in each segment are of essentially the same width and height. A solid face sheet is at said outer impact face of said segments. The vent layer has laterally vented honeycomb cells having a crush strength greater than the anticipated impact load. The layers in each segment, except for the vent layer, are individually precrushed sufficient to eliminate the initial compression load spike.

10 Claims, 4 Drawing Sheets

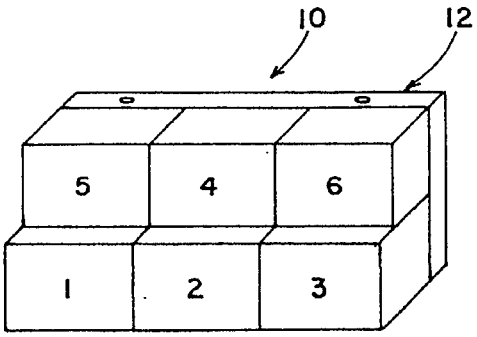
FIG. 1
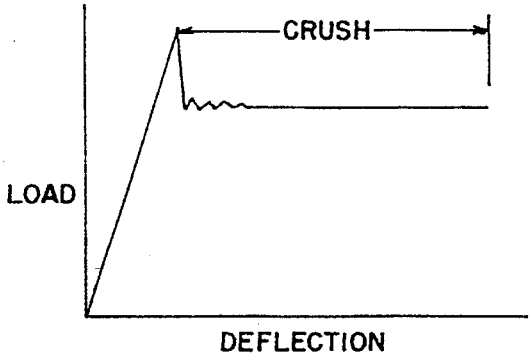
FIG. 2
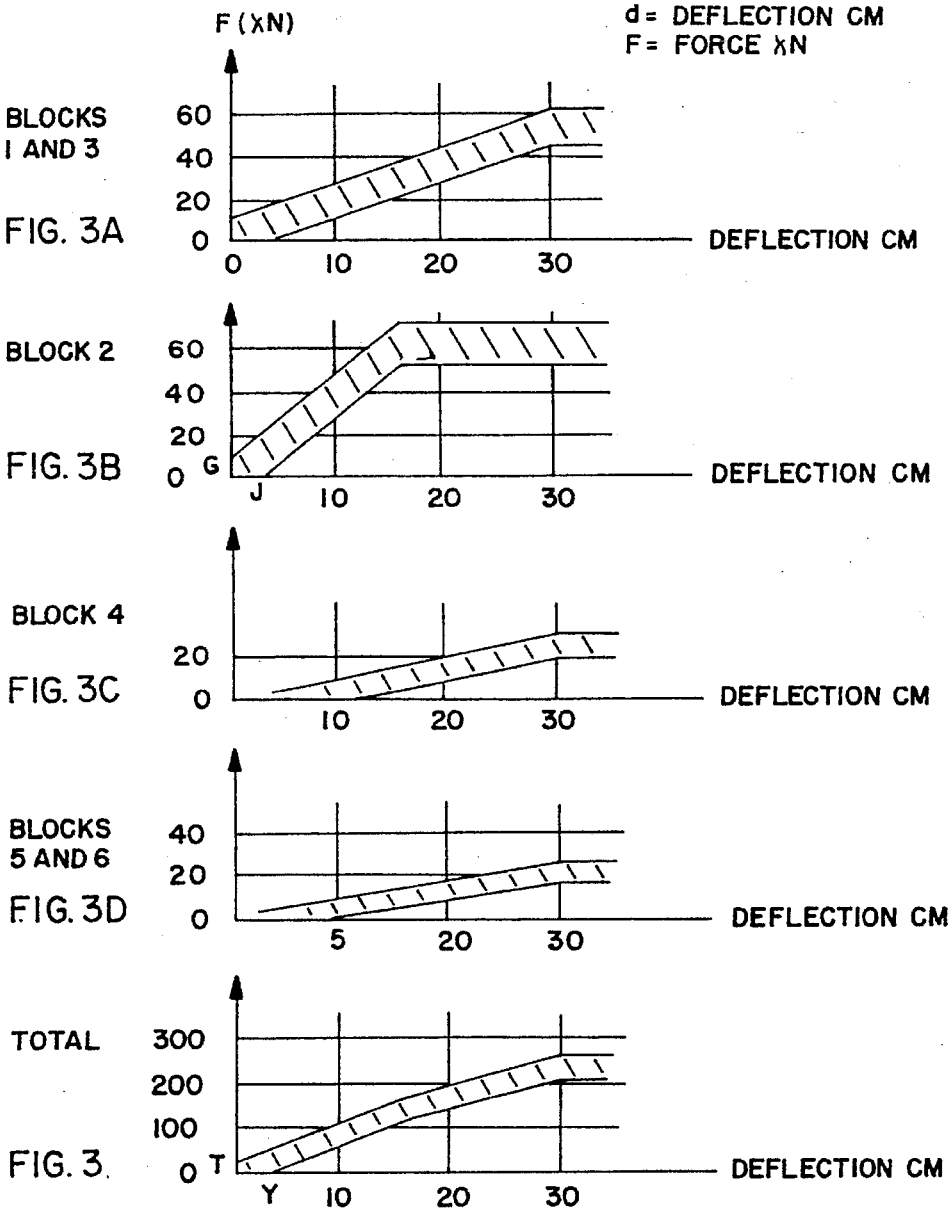

DEFORMABLE IMPACT TEST BARRIER

BACKGROUND OF THE INVENTION

This invention relates to a movable, deformable barrier simulating the front end of an automobile for crash safety evaluation.

A movable deformable barrier (MDB), i.e., impactor, is known to be used to simulate the front end of an automobile for the purpose of crash safety evaluation. The manner of usage of the MDB is to propel the MDB into an actual automobile, typically into the side of the automobile, to impact test the side of the actual automobile for safety evaluation. The MDB must first be certified as satisfactorily simulating the front end of an actual automobile. To do this, the MDB is first mounted on a mobile sled and propelled at a predetermined specified speed for impact against a solid wall having load cells thereon. The load cells and accompanying accelerometers detect the energy absorbed by each of the segments of the MDB as it crushes, and detect the total energy absorbed by the MDB by all of its segments. If the MDB meets the predetermined specified energy absorption criteria, it is certified, then duplicates of the MDB can be used for tests. I.e., the MDB is mounted on the mobile sled and used to simulate the front end of an automobile in a crash against an actual automobile. Thus, an actual automobile to be tested is substituted for the solid wall, and the MDB crashed into the actual automobile, typically into the side thereof, to test the safety characteristics of the side doors, etc. of the automobile. To make a meaningful crash test, the MDB must have load deflection characteristics that are reasonably consistent with those of a standard size automobile. For automobiles in Europe, these characteristics have been previously determined by a European governing body and are indicated in published specifications (see FIGS. 3*a*–3*d*). The specified load deflection characteristics of the MDB have also been broken down into six segments, three in a lower row and three above them in an upper row.

During certification action, the load cell wall has specific load cell zones to measure the load generated by each corresponding section of the MDB. Thus, the load cell wall is also divided into a plurality of areas, typically six areas, with independent load cells in these areas. The energy absorption data for each load cell area must fall within the maximum and minimum boundaries of the graphical representation of the limits specified by the governing body for these areas (FIGS. 3*a*–3*d*), and the energy absorption data for the total of these load cell areas must fall within the maximum and minimum boundaries of the graph specified for the total (FIG. 3).

MDB's have been known to be made of honeycomb material. The use of honeycomb as an energy absorbing material is well known because of its uniform, consistent and predictable crush characteristics. The load deflection curve of honeycomb is actually flat after the initial deformation spike. That is to say that the resultant force generated by a section of honeycomb will remain basically constant over the entire distance of crush, as shown in FIG. 2. However, the load deflection curve specified for the MDB is not flat. Instead it ramps up at a constant rate, then levels off (FIGS. 3*a*–3*d* and 3). A known method for generating this type of force deflection curve is to shape the core to varying dimensions such that the area being crushed is proportional to the force desired by providing a pyramid shaped section of honeycomb as shown in FIG. 4. While this may generally accomplish objectives of the governmental specifications, it also generates problems. Firstly, since the load is only generated at the point of contact between the shaped honeycomb and the barrier wall, there are some areas where the local crush load may be undesirably high so as to be outside of the specifications for the individual segments (FIGS. 3*a*–3*d*). This is so even though the average over the load cell wall sections may be within the "total" force specifications limits (FIG. 3). Automobiles, however, are not homogeneous structures. There are various hard spots and soft spots in an automobile structure. Depending on where the MDB with the prior art shaped honeycomb strikes the vehicle, therefore, there can be a variety of different results. If a hard spot of the MDB were to strike a soft part of the automobile, there might be considerable penetration into the vehicle. If a hard spot on the MDB were to come into contact with a hard spot on the car, the distortion might be minimal. Secondly, the side loads generated during the impact may tend to shear the prior art core because of its small cross sectional area, resulting in unpredictable crush values.

Another prior art device is an element consisting of six single blocks of polyurethane foam with different densities. To obtain desired force to deflection characteristic, parts of the material were cut out at the rear side (barrier side) as shown in FIG. 4*a*.

SUMMARY OF THE INVENTION

The novel system was developed to obtain the desired energy absorption curves, both segmented and total, without the problems generated by the shaped impactor of the prior art. To accomplish this, uniform width and height slices of honeycomb with varying crush strengths and thickness are specially bonded into a single structure for each plate (FIG. 5), each layer being separated from the adjacent layer by a perforated sheet of metal which allows air from the crushing shell layer to flow into the next layer. The final inner honeycomb layer is mounted against a metal plate, and is a thin section of noncrushing, laterally vented honeycomb, preferably slotted honeycomb, allowing air from the other layers to vent through this final layer and thereby prevent internal air pressure buildup in the honeycomb cells. The layers of each segment of the impactor have the same width and height as the other layers in the segment. The perforated sheets and slotted honeycomb layer are important to provide ventilation and prevent distortion of energy absorption during impact. During such impact, the volume of the MDB decreases in proportion to the crushed distance. The layered structure described provides proper venting from the layers of honeycomb. Without allowing the air inside the MDB to escape, the pressure would build up rapidly such that if the layers were sealed, without venting to allow air to escape, the rapid pressure rise would be proportional to the crush of the individual layers. Thus, when the pressure inside the honeycomb layer exceeded the crush strength of the succeeding honeycomb layer, that succeeding layer would begin to crush even though the previous layer had not reached its full crush distance. This would cause improper and misleading data to result.

By combining these layers in a fashion with progressively increasing crush resistance, yet of the same width and height, and effecting the venting through the perforated separated sheets and final, noncrushing, side vented layer, it is possible to generate a stair step type of crush curve that stays within the boundaries specified for each segment, as generally depicted in FIG. 6, and without the disadvantages of the prior art shaped MDB. Each layer crushes uniformly throughout its thickness until it reaches its maximum crush distance. At that point the load increases until it exceeds the minimum crush strength of the following layer, which will then begin to crush, and so on through the entire range of the MDB, the energy absorption creating something like a stair step appearance as graphically illustrated in FIGS. *7a–7d*. The total energy absorption of all the segments is depicted in FIG. 7. For each segment there is a different combination of honeycomb types and thicknesses designed to allow the load deflection to match the corresponding curve. A key is in controlling the crush strength of the layers of honeycomb. Crush strength of honeycomb is mainly a function of the material, density, and material properties. The distance that honeycomb can be crushed before it reaches its maximum crush distance is about 80% of its original thickness for core over one inch thick. Therefore, honeycomb layers are selected to give a predetermined resistance to crush as set forth in chart A. The individual segments so formed are combined into the plural segment, normally six segment, MDB in FIG. 8, the back face being secured to a solid backing as of metal, and the front face being enclosed by a thin solid face sheet as of metal.

Some advantages of the layered honeycomb over the shaped prior art honeycomb are as follows:

1. Uniform impact resistance over entire surface (no hard or soft spots);

2. Resistance to the effects of lateral shear;

3. Structural integrity (less likely to disintegrate during impact).

Aspects of design:

1. Successive layers of honeycomb sheets with progressively higher crush strengths;

2. Each layer is separated from and attached to the next by a perforated sheet;

3. The last, i.e., core, layer of honeycomb is laterally slotted and higher in compressive strength than anticipated loading;

4. Perforated sheets and slotted core layer provide passage for air to exit the honeycomb to prevent pressure buildup during impact;

5. Honeycomb does not need to be perforated, except the slotted core layer;

6. Honeycomb layers may each be readily prefailed, i.e., precrushed, to eliminate the initial compression load spike in load deflection curve;

7. Solid facing sheet distributes loading evenly and stiffens structure while providing uniform appearance; and 8. The construction is recyclable if of like materials such as metal, paper and/or thermoplastics.

BRIEF DESCRIPTION OF THE DRAWINGS

FIG. 1 is a perspective view of a movable deformable barrier;

FIG. 2 is a graph diagram of a load versus deflection curve of a honeycomb layer;

FIG. 3 is a graph of specified combined ranges of characteristics of the total movable deformable barrier;

Figure 5:
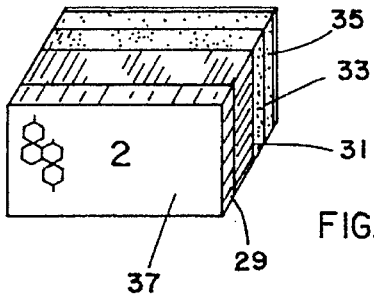
Figure 4:
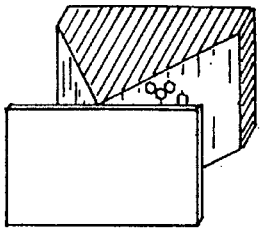
FIG. 4 PRIOR ART
Figure 6:
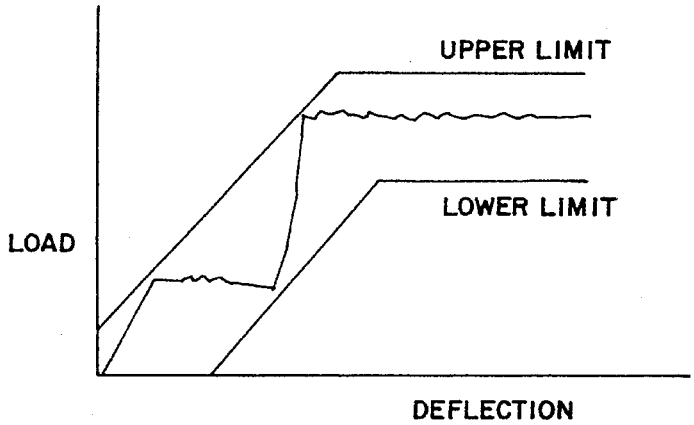
Figure 8A:
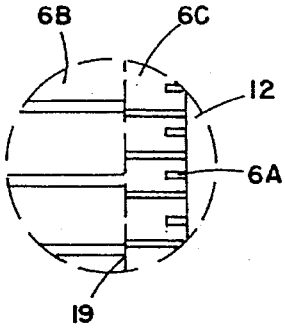
Figure 8:
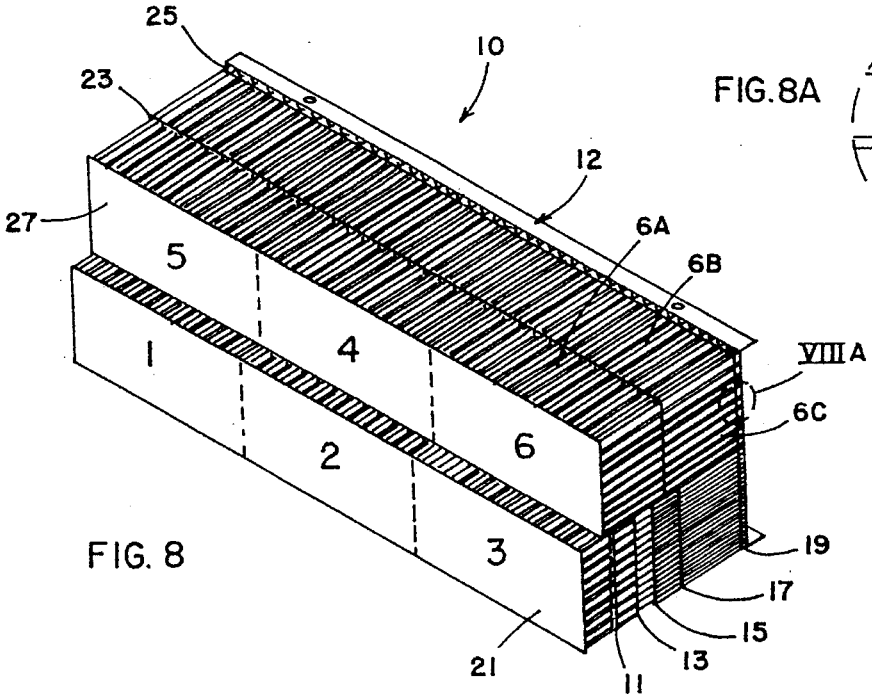
Figure 7A:
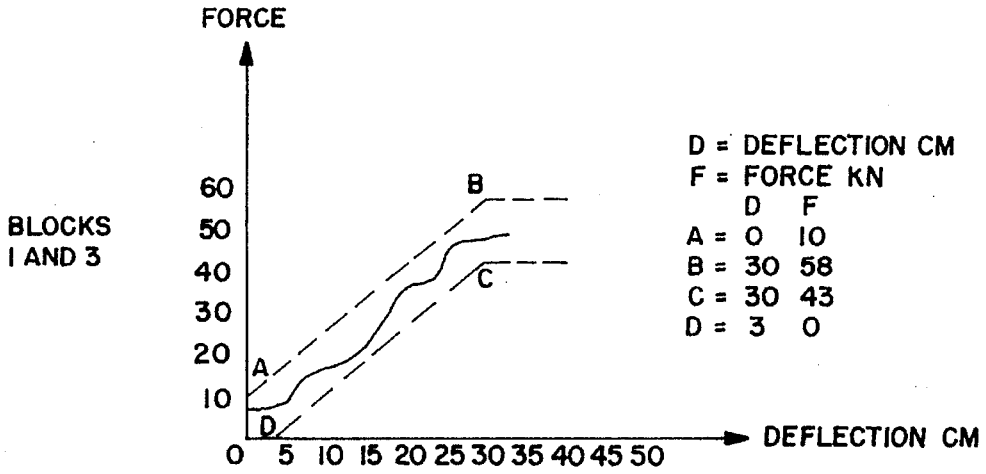
Figure 7B:
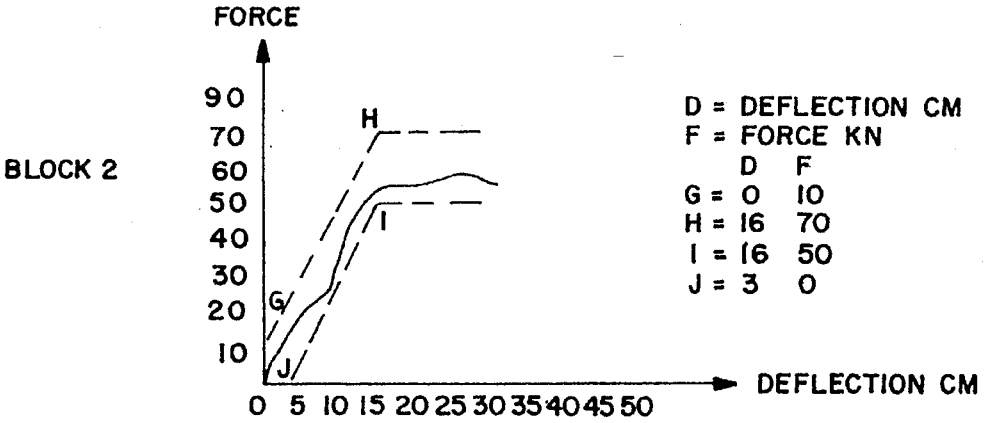
Figure 7C:
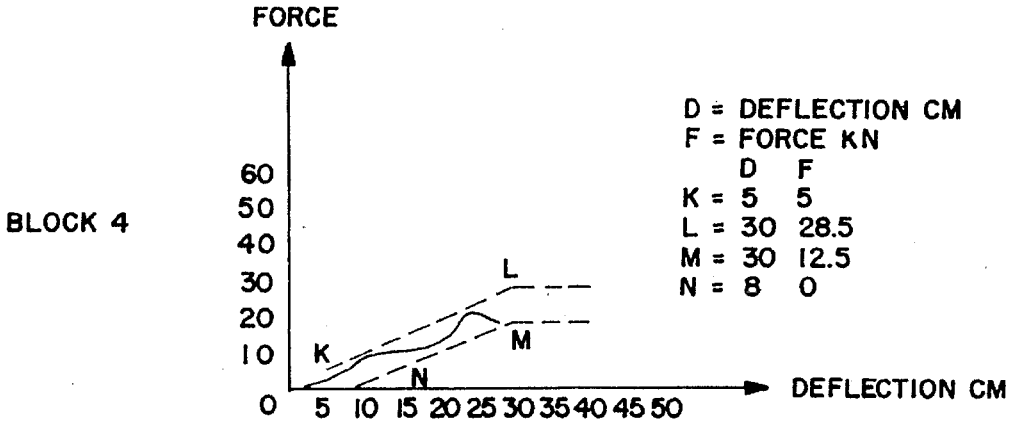
Figure 7D:
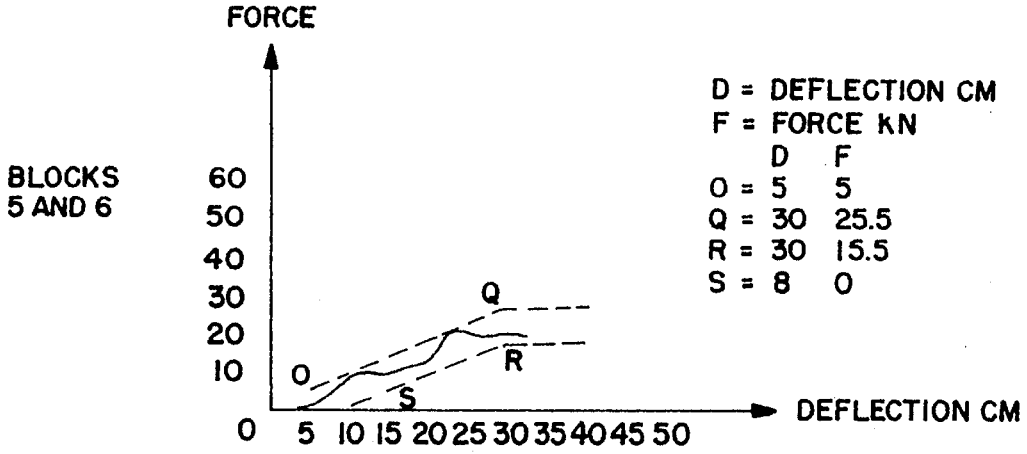
Figure 7:
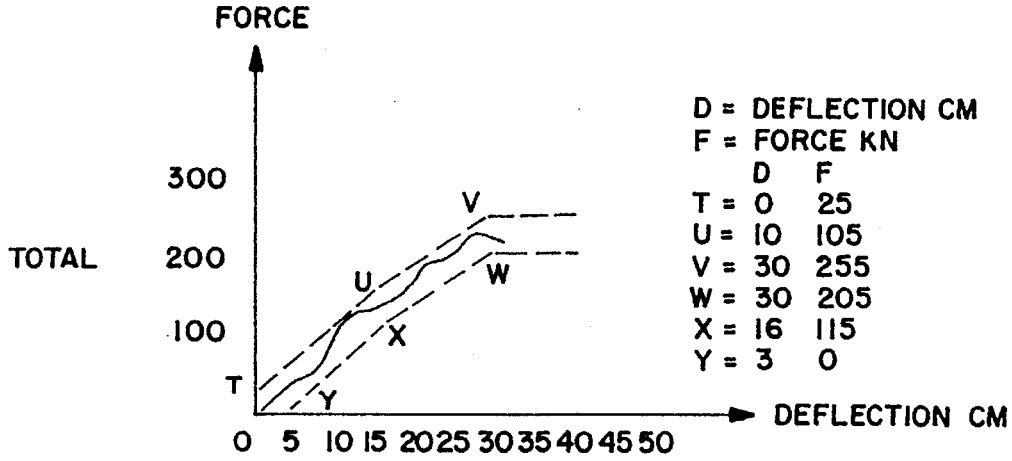
Figure 4A:
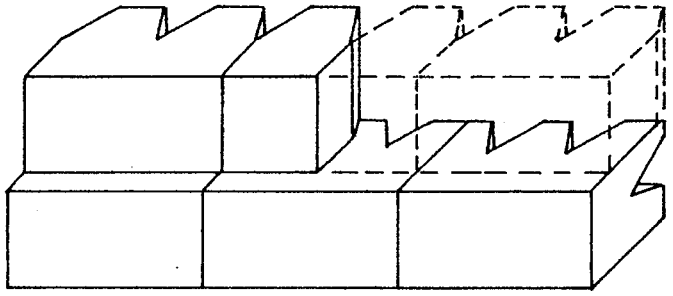

FIGS. *3a–3d* are graphs of specified characteristics ranges for segments of a movable deformable barrier;

FIG. 4 is a perspective view of a prior art barrier;

FIG. *4a* is a perspective view of another prior art barrier;

FIG. 5 is a perspective view of one segment of the novel barrier;

FIG. 6 is a graph of the load versus deflection curve illustrating a stair-step curve within the upper and lower specified limits;

FIG. 7 is a graph of the total combined characteristics of the novel barrier relative to the specified range of characteristics;

FIGS. *7a–7d* are graphs of characteristics of the novel barrier relative to specified ranges thereof;

FIG. 8 is a perspective view of the novel movable deformable barrier; and

FIG. *8a* is a fragmentary enlarged sectional view of a portion of the MDB in FIG. 8.

DESCRIPTION OF THE PREFERRED EMBODIMENT

Referring now specifically to the drawings, FIGS. 1 and 8 depict an MDB 10 formed of a plurality of segments, here shown to be six in number, with the segments being grouped in two rows, one above the other. The segments 1, 2 and 3 are shown in the bottom row in that order, with segments 5, 4 and 6 in the top row in that order, segment 5 being above 1, segment 4 being above 2, and segment 6 being above 3. These segments are all mounted on a rigid vertical support panel 12 capable of being mounted to a conventional movable sled (now shown). This panel is typically of metal which is alone or in combination with a further backup support is sufficiently rigid so as to not buckle or bend significantly when impact the MDB against an automobile being tested. The sled employed for this purpose is conventional and therefore not shown. The individual segments 1–6 of the MDB are mounted to panel 12 to form the assembly 10. In the preferred embodiment depicted, segments 1 and 3 each comprise six layers, segments 4, 5 and 6 each comprise three layers, and segment 2 comprises five layers. The honeycomb cells in each layer are oriented axially to the impact, i.e., normal to support 12 and to the front cover sheet of each segment. Characteristics of these layers are set forth in chart form hereafter. Each of these layers is preferably precrushed a small amount prior to assembly, sufficient to obviate the typical compression spike illustrated at the left end of the graph curve in FIG. 2. Therefore, further crush of each layer of honeycomb under a force greater than the resistance force generated by each layer of honeycomb will be basically constant over the entire distance of crush for that layer. By combining several layers of equal width and height, but of differing thicknesses and other characteristics such as density, i.e., number and size of honeycomb cells, and alloy and temper of the foil, it is possible to create a segment wherein the first layer will crush to its maximum of approximately 80% of its thickness, then the second layer crush to approximately 80% of its thickness, and so on through the third and successive layers except for the very last layer which in each segment comprises a thin honeycomb layer having a strength greater than the anticipated force in the impact test, so that this last layer does not crush. This last core layer is laterally vented, preferably by having laterally slotted honeycomb cells, so that it can vent the air being forced from each of the other layers and thereby prevent distorted readings and effects which would be caused by trapped air pressure within the crushing honeycomb layers. For example, referring to FIG. 8 and segment 6 therein, this segment has three layers *6a*, *6b* and *6c*, with the honeycomb cell size decreasing from layer *6a* to *6c*. Layer *6c* has laterally slotted honeycomb cells as shown in enlarged fragmentary FIG. *8a* at slots *6s*.

Perforated support and bonding sheets, preferably of metal, are positioned between adjacent layers of honeycomb. Thus, for segments 1 and 3 there will be five such sheets, sheet 11 between the first and second layer, sheet 13 between the second and third layer, sheet 15 between the third and fourth layer, sheet 17 between the fourth and fifth layer, and sheet 19 between the fifth and sixth layer. The sixth layer is backed by the imperforate support plate 12. A thin cover sheet 21 is over the face of the first layer. Similarly, for segments 4, 5 and 6, there are two perforated separator sheets 23 and 25 between the first and second and second and third layers, respectively, the third layer being mounted on panel 12 and the first layer having a face sheet 27. Finally, segment 2 has four perforated separator sheets 29, 31, 33 and 35 between the successive layers, the rearwardmost layer being mounted on panel 12 and the forwardmost layer having a face covering sheet 37.

In use, the MDB mounted on a mobile sled is crashed into an automobile, such as into the side doors thereof, to evaluate the safety characteristics of the automobile. An MDB in accordance with this invention, assembled in the manner depicted in FIG. 8, was tested and found to have crush characteristics for the individual segments or blocks depicted in FIGS. *7a*, *7b*, *7c* and *7d*, with the combined total in FIG. 7. All of these graphs represent the results of dynamic testing except for the curve in FIG. *7a* which was determined by a static test. The particular number of layers employed for each segment or block, and the characteristics of the particular layers of honeycomb, may be varied somewhat but still be capable of falling within the ascending maximum and minimum specification boundaries required for the individual segments or blocks. The illustrative embodiment depicted met the force-crush distance specifications of the European requirements and thus is preferred. The graph depicts the crush characteristics in centimeters of deflection perforce in kilonewtons.

HONEYCOMB CORE MATERIALS FOR IMPACTOR

| Core Material | Cut Thickness | Pre-Crushed Thickness | Strength |
|---|---|---|---|
| | Impactor Segments 1, 3 | | |
| 1" cell | 4.000" | 3.75" | 8–12 psi crush |
| 1" cell | 2.750" | 2.50" | 16–20 psi crush |
| ¾" cell | 2.430" | 2.18" | 25–30 psi crush |
| ½" cell | 3.500" | 3.25" | 32–40 psi crush |
| ⅜" cell | 7.750" | 7.50" | 50–60 psi crush |
| ¼" cell | .500" | — | Slotted core, not crushed |
| | Impactor Segments 4, 5, 6 | | |
| 1" cell | 7.750" | 7.50" | 8–12 psi crush |
| 1" cell | 9.570" | 9.32" | 16–20 psi crush |
| ¼" cell | .500" | — | Slotted core, not crushed |
| | Impactor Segment 2 | | |
| 1" cell | 2.750" | 2.50" | 8–12 psi crush |
| 1" cell | 1.500" | 1.25" | 16–20 psi crush |
| ½" cell | 1.850" | 1.60" | 32–40 psi crush |
| ¾" cell | 13.980" | 13.83" | 50–60 psi crush |
| ¼" cell | .500" | — | Slotted core, not crushed |

The material was preferably that designated as alloy type 3003 aluminum, but it can be of other metals, paper and/or plastic.

Conceivably those persons knowledgeable in this field of endeavor will, upon studying this disclosure, consider various modifications and/or improvements to the inventive concept presented, but still within this concept. Therefore, the invention herein is not to be limited to the preferred embodiments set forth as exemplary of the invention, but only by the scope of the claims and the equivalents thereto.

The embodiments of the invention in which an exclusive property or privilege is claimed are defined as follows:

1. An impactor for a movable, deformable barrier simulating an automobile, comprising:

an upright, solid backing support having a support face;

a plurality of energy absorbing impact segments protruding from said support face;

each said segment having an outer impact face and each comprising a plurality of layers of honeycomb having crush strengths characterized by increasing crush strength of successive layers from said outer impact face to said support;

said layers being separated by and secured to perforate plates therebetween allowing air flow from a crushing layer to the succeeding layers when said layers are successively crushed; and each impact segment having a thin vent layer adjacent said support for discharge of air from all of said segments as they are successively crushed.

2. The movable deformable barrier impactor in claim 1 wherein said layers in each segment are of essentially the same width and height.

3. The impactor for a movable, deformable barrier in claim 1 including a solid face sheet at said outer impact face of said segments.

4. The impactor for a movable deformable barrier in claim 1 wherein said vent layer comprises laterally vented honeycomb cells.

5. The movable deformable barrier impactor in claim 4 wherein said laterally vented honeycomb is slotted honeycomb.

6. The movable deformable barrier impactor in claim 4 wherein said layers of honeycomb comprise aluminum.

7. The movable deformable barrier impactor in claim 1 wherein said layers in each segment, except said vent layer, are individually precrushed sufficient to eliminate the initial compression load spike.

8. The movable deformable barrier impactor in claim 1 wherein said plurality of energy absorbing impact segments is six.

9. The movable deformable barrier impactor in claim 8 wherein said six segments are arranged in two vertical rows, the bottom row comprising segments 1, 2 and 3 in that order, and the top row comprising segments 5, 4 and 6 in that order, with 5 being above 1, 4 being above 2, and 6 being above 3, said segments 1 and 3 being alike and said segments 4, 5 and 6 being alike.

10. The movable deformable barrier impactor in claim 1 wherein said layers of honeycomb are formed of at least one of the materials consisting of aluminum, plastic and paper.

* * * * *

UNITED STATES PATENT AND TRADEMARK OFFICE

CERTIFICATE OF CORRECTION

PATENT NO. : 5,620,276
DATED : April 15, 1997
INVENTOR(S) : Michael C. Niemerski et al.

It is certified that error appears in the above-identified patent and that said Letters Patent is hereby corrected as shown below:

Column 2, lines 18 and 19;

"cross sectional" should be –cross-sectional–.

Column 4, line 27;

"now" should be –not–.

Column 5, line 36;

"perforce" should be –per force–.

Signed and Sealed this

Twenty-third Day of September, 1997

*Attest:*

*Attesting Officer*

BRUCE LEHMAN

*Commissioner of Patents and Trademarks*